US011536454B2

(12) United States Patent
Hu

(10) Patent No.: US 11,536,454 B2
(45) Date of Patent: Dec. 27, 2022

(54) COMBUSTOR WALL ASSEMBLY FOR GAS TURBINE ENGINE

(71) Applicant: PRATT & WHITNEY CANADA CORP., Longueuil (CA)

(72) Inventor: Tin-Cheung John Hu, Markham (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 55 days.

(21) Appl. No.: 16/715,022

(22) Filed: Dec. 16, 2019

(65) Prior Publication Data

US 2020/0355369 A1 Nov. 12, 2020

Related U.S. Application Data

(60) Provisional application No. 62/845,404, filed on May 9, 2019.

(51) Int. Cl.
*F23R 3/00* (2006.01)

(52) U.S. Cl.
CPC ..... *F23R 3/002* (2013.01); *F23R 3/007* (2013.01); *F23R 2900/00012* (2013.01); *F23R 2900/00017* (2013.01); *F23R 2900/00018* (2013.01); *F23R 2900/03044* (2013.01)

(58) Field of Classification Search
CPC ..... F23R 3/002; F23R 3/007; F23R 2900/00012; F23R 2900/00017; F23R 2900/00018; F23R 2900/03044
See application file for complete search history.

(56) References Cited

U.S. PATENT DOCUMENTS

| | | | | |
|---|---|---|---|---|
| 6,901,757 | B2 | 6/2005 | Gerendas | |
| 7,117,983 | B2 * | 10/2006 | Good | F01D 9/04 188/380 |
| 8,359,865 | B2 | 1/2013 | Dierberger et al. | |
| 8,359,866 | B2 | 1/2013 | Dierberger et al. | |
| 9,534,783 | B2 | 1/2017 | Dierberger et al. | |
| 2003/0010038 | A1 * | 1/2003 | Maghon | F23R 3/002 60/796 |
| 2009/0260364 | A1 * | 10/2009 | Keller | F01D 25/005 60/753 |
| 2012/0260657 | A1 * | 10/2012 | Eroglu | F23M 20/005 60/725 |
| 2014/0147251 | A1 * | 5/2014 | Reinert | F23R 3/007 415/119 |
| 2014/0150435 | A1 * | 6/2014 | Maurer | F23R 3/00 60/752 |
| 2015/0330633 | A1 | 11/2015 | Graves et al. | |

(Continued)

*Primary Examiner* — Ehud Gartenberg
*Assistant Examiner* — Henry Ng
(74) *Attorney, Agent, or Firm* — Norton Rose Fulbright Canada LLP

(57) ABSTRACT

Wall assemblies for a combustor of a gas turbine engine are disclosed. A wall assembly comprises an outer shell made of a metallic material, adjacent first and second inner panels mounted to the outer shell via an insert and a damper disposed between the outer shell and at least one of the first and second inner panels. The first and second inner panels may be spaced apart from the outer shell to define a double-wall configuration with the outer shell. The first and second inner panels may be made of a composite material. The insert may be made from substantially the same or other type of composite material.

19 Claims, 7 Drawing Sheets

(56) References Cited

U.S. PATENT DOCUMENTS

| | | | | |
|---|---|---|---|---|
| 2016/0238247 | A1 | 8/2016 | Staufer | |
| 2017/0122561 | A1* | 5/2017 | Nagaraj | F01D 5/288 |
| 2018/0202659 | A1* | 7/2018 | Stieg | F23R 3/007 |
| 2018/0340687 | A1* | 11/2018 | Morrison | F23R 3/002 |
| 2019/0107286 | A1* | 4/2019 | Buse | F23R 3/007 |

* cited by examiner

COMBUSTOR WALL ASSEMBLY FOR GAS TURBINE ENGINE

CROSS REFERENCE TO RELATED APPLICATION AND CLAIM OF PRIORITY

The present application claims priority to U.S. provisional patent application No. 62/845,404 filed on May 9, 2019, the entire contents of which are hereby incorporated by reference.

TECHNICAL FIELD

The disclosure relates generally to gas turbine engines, and more particularly to combustors of gas turbine engines.

BACKGROUND

Ceramic matrix composite (CMC) parts are used in combustors for their ability to withstand the harsh conditions associated with combustion. The CMC parts may be assembled with other metallic parts to construct the combustor. However, the CMC parts and the metallic parts may have different coefficients of thermal expansion and therefore combining CMC parts with metallic parts in combustors can be challenging.

SUMMARY

In one aspect, the disclosure describes a combustor of a gas turbine engine. The combustor comprises:

an outer shell made of a metallic material;

a plurality of inner panels mounted to the outer shell, the inner panels spaced inwardly from the outer shell to define a double-wall configuration with the outer shell, the inner panels made of a ceramic material; and a damper disposed between the outer shell and at least one of the inner panels.

In another aspect, the disclosure describes a combustor of a gas turbine engine. The combustor comprises:

an outer shell;

a plurality of inner panels mounted to the outer shell, the inner panels spaced inwardly from the outer shell to define a double-wall configuration with the outer shell, the inner panels having a higher heat resistance than the outer shell; and a damper disposed between the outer shell and at least one of the inner panels.

In a further aspect, the disclosure describes a gas turbine engine having a combustor as disclosed herein.

Further details of these and other aspects of the subject matter of this application will be apparent from the detailed description included below and the drawings.

DESCRIPTION OF THE DRAWINGS

Reference is now made to the accompanying drawings, in which:

FIG. 3 is a schematic cross-sectional view of another exemplary wall assembly of the combustor of the engine of FIG. 1;

DETAILED DESCRIPTION

The following disclosure relates to wall assemblies for combustors of gas turbine engines. In some embodiments, the wall assemblies disclosed herein can mitigate the effects of thermal mismatch between components made from materials having different coefficients of thermal expansion. In some embodiments, the wall assemblies disclosed herein can facilitate the integration of ceramic inner panels of combustors with metallic outer shells. In some embodiments, one or more dampers can be disposed between components of the wall assemblies of the combustor to help mitigate the effects of thermal mismatch.

Aspects of various embodiments are described through reference to the drawings.

Figure 1:
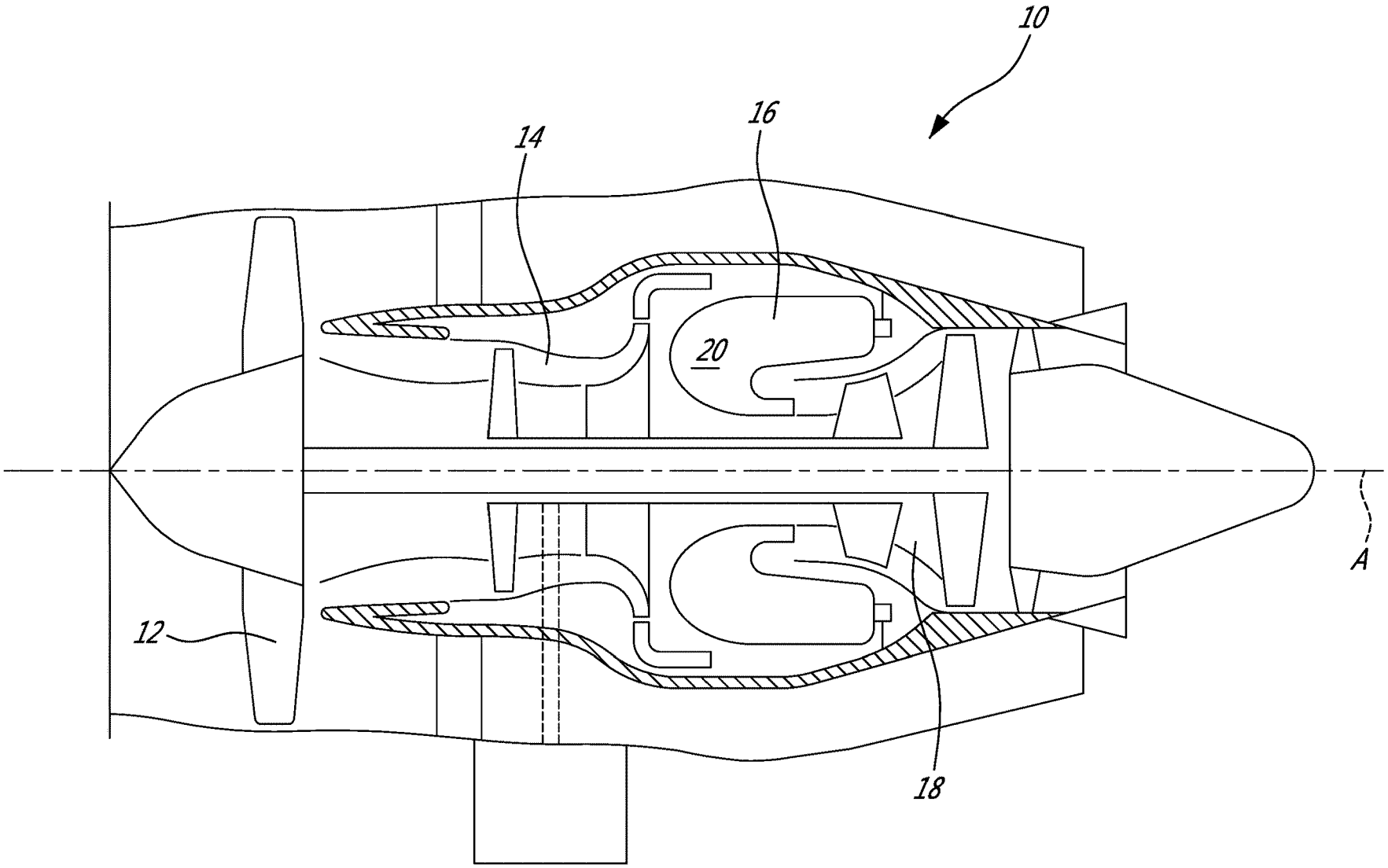
FIG. 1 is a schematic axial cross-sectional view of a turbo-fan gas turbine engine including a combustor with a wall assembly as disclosed herein.

FIG. 1 illustrates a gas turbine engine 10 of a type preferably provided for use in subsonic flight, generally comprising, in serial flow communication, a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases. Engine 10 shown in FIG. 1 is of the turbo-fan type but it is understood that the combustors, wall assemblies and other aspects disclosed herein are also applicable to gas turbine engines of other types such as turbo-prop, turbo-shaft or auxiliary power unit (APU) for example. In various embodiments, combustor 16 may be a reverse-flow type combustor, an annular straight-through combustor or a can-type combustor for example. Combustor 16 may define a combustion chamber and may have a double-wall construction having a wall-assembly as described below. Combustor 16 may have an annular shape about central axis A.

Figure 2A:
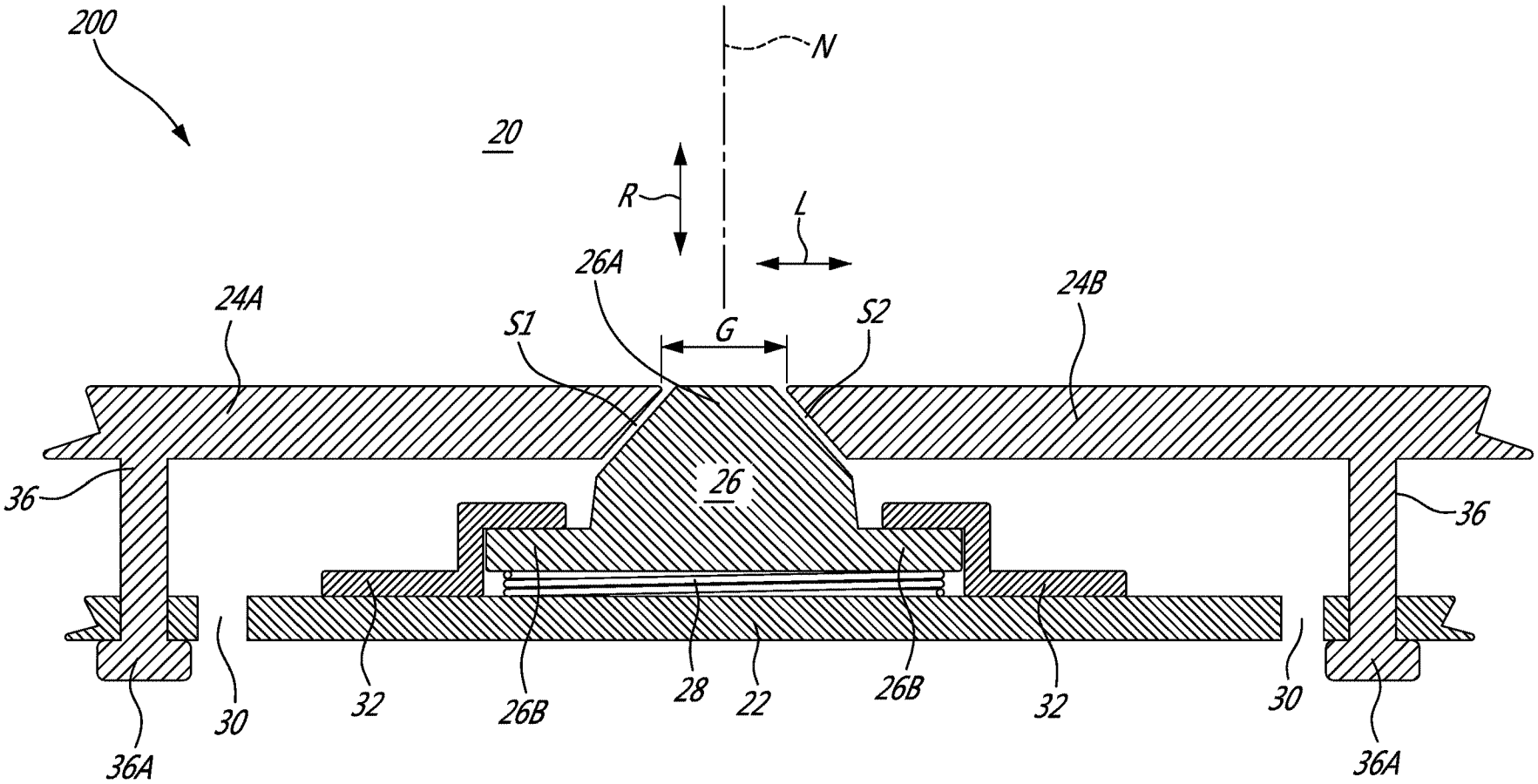
FIG. 2A is a schematic cross-sectional view of an exemplary wall assembly of the combustor of the engine of FIG. 1.

FIG. 2A is a schematic cross-sectional view of an exemplary wall assembly 200 of combustor 16 of engine 10. Wall assembly 200 may define a radially-outer or a radially-inner wall of combustor 16. Wall assembly 200 may include outer shell 22, a plurality (e.g., first and second) inner panels 24A, 24B mounted to outer shell 22 via insert 26. One or more dampers 28 may be disposed between outer shell 22 and at least one of the first and second inner panels 24A and/or 24B.

Outer shell 22 may define an exterior of combustor 16. Outer shell 22 may also be referred to as an "outer skin" of combustor 16. Outer shell 22 may be made of a metallic material. For example, outer shell 22 may be made of a metallic alloy suitable to withstand the conditions associated with combustor 16. In some embodiments, outer shell 22 may be made from a suitable nickel-based alloy. Outer shell 22 may define a structure of combustor 16 and support inner panels 24A, 24B. Outer shell 22 may have a single-piece (i.e., unitary) construction or may have a plurality of interconnected segments. Although not shown, connectors, beams, stiffeners or other components may be provided on outer shell 22 to permit the connection of outer shell 22 to a structure (e.g., case) of engine 10. Outer shell 22 may include (e.g., impingement cooling) holes 30 formed therethrough to permit pressurized air delivered from compressor 14 to permeate outer shell 22 via holes 30 and provide cooling for example.

Inner panels 24A, 24B may delimit combustion chamber 20 of combustor 16 and may therefore be directly exposed to the harsh environment (e.g., combustion gases and temperatures) inside of combustor 16. Inner panels 24A, 24B may also be referred to as "heat shields" or "tiles". Inner panels 24A, 24B may be made of a composite material such as a ceramic matrix composite (CMC) or of other material(s) using suitable manufacturing procedures. Inner panels 24A, 24B may be made of a non-metallic material(s). Inner panels 24A, 24B and outer shell 22 may be made from different materials and accordingly may have different coefficients of thermal expansion. For example, inner panels 24A, 24B may have a higher heat resistance than outer shell 22. In other words, the material of inner panels 24A, 24B may have material properties that are suitable for exposure to higher temperatures than the material of outer shell 22.

The CMC from which inner panels 24A, 24B may be made may include ceramic fibres embedded in a ceramic matrix. The matrix and fibres can be any suitable ceramic material(s), where carbon and carbon fibres can also be considered a ceramic material. For example, the CMC can include ceramic fibers, silicon carbide fibres, alumina fibres, mullite fibres and/or carbon fibers embedded in a ceramic matrix. The matrix material of inner panels 24A, 24B can be the same as that of the fibres or can be different from that of the fibres.

Inner panels 24A, 24B may be arranged to define an inner wall of wall assembly 200. Accordingly, inner panels 24A, 24B may be spaced apart from outer shell 22 in order to define a double-wall configuration with outer shell 22. FIG. 2A shows a region of wall assembly 200 where adjacent inner panels 24A, 24B are mounted to outer shell 22 via insert 26. However, it is understood that wall assembly 200 may include more than two inner panels 24A, 24B (e.g., arranged in an array) mounted to outer shell 22 via a plurality of inserts 26. In various embodiments, inner panels 24A, 24B may have annular configuration and extend completely (e.g., 360°) around axis A (see FIG. 1). For example, inner panels 24A and/or 24B may each be a single annular body. Alternatively, the inner wall of wall assembly 200 may be defined by a plurality of inner panels 24A, 24B circumferentially distributed about axis A. It is understood that the assemblies described herein can be used at one or more interfaces between the plurality of circumferentially distributed inner panels 24A, 24B. In various embodiments, one or both inner panels 24A, 24B may have a planar or a curved configuration. In some embodiments, one or both inner panels 24A, 24B may be doubly curved. In various embodiments, facing surfaces of inner panels 24A, 24B and of outer shell 22 may be concave or convex.

Adjacent inner panels 24A, 24B may be positioned to define gap G therebetween. In some embodiments, the size of gap G may be determined as a function of a length of inner panels 24A, 24B. In various embodiments, the size of gap G may be between 2 mm and 10 mm. In some embodiments, at least part 26A of insert 26 may be disposed in gap G between inner panels 24A, 24B. Part 26A of insert 26 can be designed to provide one or more sealed interfaces S1, S2 between insert 26 and inner panels 24A, 24B. Such sealing function provided by insert 26 may not be absolute and sealed interfaces S1, S2 may be designed to allow some amount for leakage flow of pressurized air into combustion chamber 20. During operation of engine 10, pressurized air provided by compressor 14 may pass through outer shield 22 via holes 30 and then enter combustion chamber 20 via sealed interfaces S1, S2. However, the use of insert 26 as disclosed herein may, in some situations, reduce unwanted leakage flow out of gap G and provide relatively consistent sealing.

Insert 26 may be made from substantially the same or other type of (e.g., composite) material as inner panels 24A, 24B in order to reduce or substantially eliminate thermal expansion mismatch between insert 26 and inner panels 24A, 24B. For example, insert 26 and inner panels 24A, 24B may be made of CMC. The term "substantially" as used herein may be applied to modify any quantitative representation which could permissibly vary without resulting in a change in the basic function to which it is related.

In some embodiments, the sealing faces on insert 26 and the corresponding sealing faces on inner panels 24A, 24B may be oblique to a direction N normal to an inner surface of outer shell 22 at the location of insert 26. In some embodiments, normal direction N may be a normal of an inner surface of inner panel 24A and/or of inner panel 24B. In other words, part 26A of insert 26 disposed in gap G between inner panels 24A, 24B may taper away from outer shell 22. In some embodiments, the contact faces of part 26A of insert 26 may have a substantially planar or non-planar cross-sectional profile and may be at an angle between 10° and 80° from normal direction N. In some embodiments, the contact faces on part 26A of insert 26 may have a substantially planar cross-sectional profile and may be at an angle between 30° and 60° from normal direction N.

The sealing faces on part 26A of insert 26 and the sealing faces of the edges of inner panels 24A, 24B defining gap G may be configured to contact each other and provide a sliding fit between insert 26 and inner panels 24A, 24B in order to accommodate thermal expansion and maintain at least some sealing function of insert 26 at different thermal expansion scenarios. For example, one or more contact faces of part 26A of insert 26 and one or more corresponding contact faces of inner panels 24A, 24B may be in sliding engagement with each other to accommodate relative movement. For example, as the size of gap G is reduced by movement of the edges of inner panels 24A, 24B along arrow L, part 26A of insert 26 may get partially pushed out of gap G along arrow R by way of the contacting oblique sealing faces providing a wedge effect. Conversely, as the size of gap G is increased, part 26A of insert 26 may get pushed in gap G by way of damper 28 and the oblique sealing faces. Such arrangement may, in some situations, help maintain the sealing function of insert 26 while also reducing or substantially eliminating fretting and/or unwanted stresses between interfacing components.

In some embodiments, insert 26 may be secured to outer shell 22 via one or more retainers 32. Retainers 32 may be Z-shaped clips or brackets that are secured to outer shell 22 by one or more welds or suitable fasteners for example. Retainers 32 may provide relatively rigid connections to outer shell 22 compared to damper 28. Retainers 32 may be made from a metallic material. In some embodiments, retainers 32 may be made from substantially the same material as that of outer shell 22. Retainers 32 may engage with one or more lower flanges 26B of insert 26 in order to limit movement of insert 26 along one or more degrees of freedom. For example, the configuration of retainers 32 shown in FIG. 2A may limit inward movement of insert 26 relative to outer shell 22 while providing some allowance for inward/outward movement of insert 26 relative to outer shell 22 permitted by damper 28. In some embodiments, retainers 32 may also limit lateral movement of insert 26 relative to outer shell 22.

Damper 28 may be disposed between outer shell 22 and insert 26 to provide some damping therebetween. In various embodiments, damper 28 may provide a flexible connection between components to allow for some relative movement to accommodate thermal expansion and avoid the risk of excessive thermally-induced stresses to be developed in components. For example, damper 28 may help accommodate thermal mismatch between inner panels 24A, 24B, insert 26 and outer shell 22. In some embodiments, other means such as one or more bolts or pins 36 for securing inner panels 24A, 24B to outer shell 22 may be provided. Alternatively, inner panels 24A, 24B may be in a "floating" configuration relative to outer shell 22 and the use of insert 26 and damper 28 may provide a flexible mount for supporting inner panels 24A, 24B in a spaced apart relation to outer shell 22. In some embodiments, wall assemblies such as assemblies 300, 500 and 600 (see FIGS. 3, 5 and 6) may be devoid of bolts or other fastener(s) rigidly securing inner panels 24A, 24B to outer shell 22 and inner panels 24A, 24B may be considered "floating" within outer shell 22.

In some embodiments, damper 28 may be a resilient member. In some embodiments, damper 28 may be a (e.g., helical coil, leaf or Belleville) spring made of a metallic material that is suitable for use in the applicable operating conditions. For example, such spring may be made of a suitable nickel-based alloy or cobalt-based alloy. Damper 28 may be a compression spring made of a suitable high-temperature alloy. Damper 28 may include a (e.g., custom) wire form.

Figure 2B:
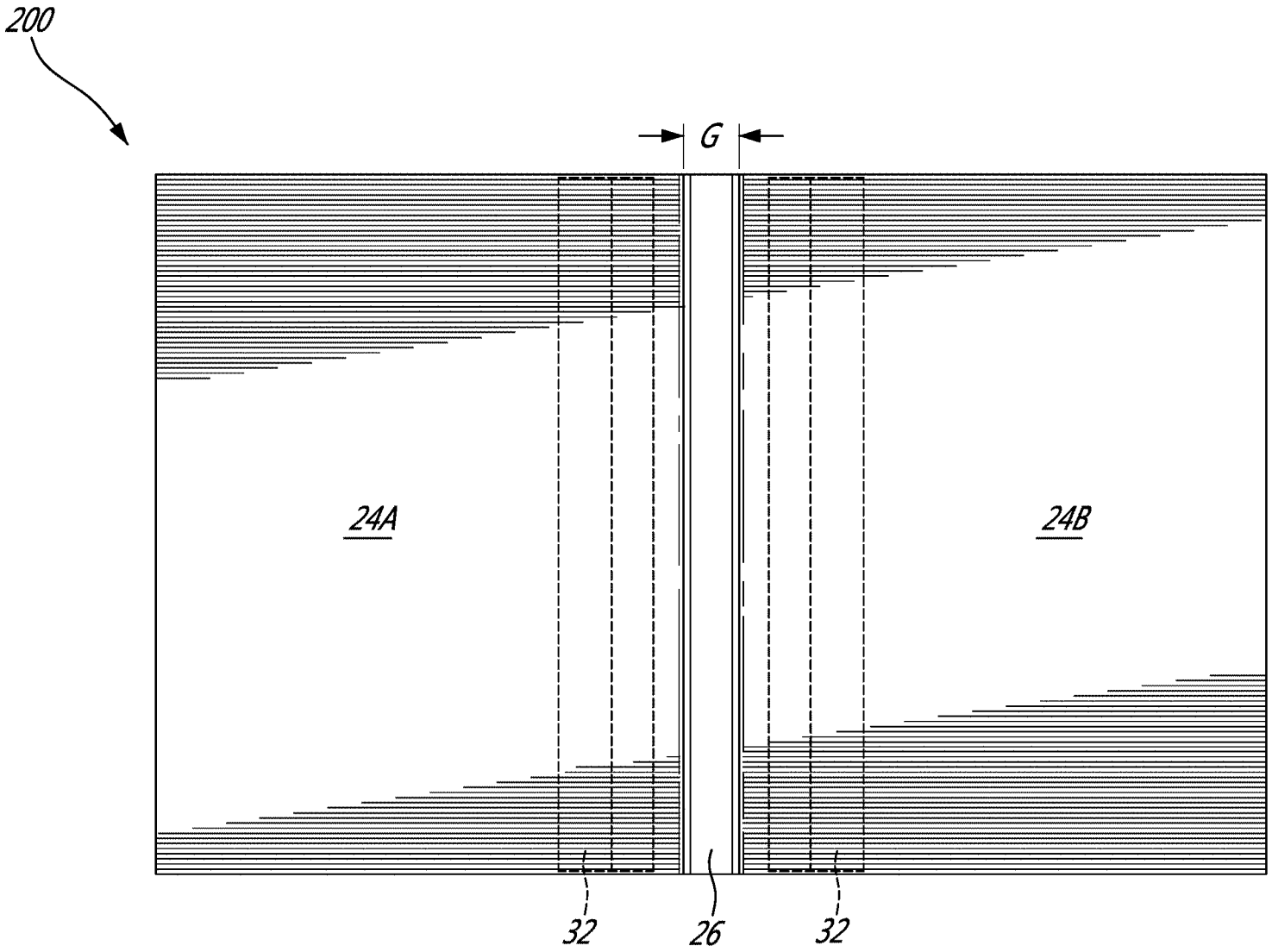
FIG. 2B is a schematic plan view of the wall assembly of FIG. 2A viewed from inside the combustor.

FIG. 2B is a schematic plan view of wall assembly 200 of FIG. 2A viewed from inside combustor 16. Retainers 32 disposed under inner panels 24A, 24B are illustrated in stippled lines. Insert 26 may have an elongated shape. Insert 26 may also be referred to as a rail. In some embodiments, insert 26 may have a substantially uniform cross-sectional profile along its length. Insert 26 may be shaped to substantially follow the contour of the edges of inner panels 24A, 24B.

FIGS. 3-6 respectively illustrate other exemplary wall assemblies 300, 400, 500 and 600 of combustor 16 that may have elements in common with wall assembly 200 described above. Like elements have been identified using like reference numerals and associated descriptions included above and applicable to elements of wall assemblies 300, 400, 500 and 600 is not repeated below. It is understood that elements from wall assemblies 200, 300, 400, 500 and 600 may be combined to form other embodiments not specifically illustrated herein.

FIG. 3 is a schematic cross-sectional view of another exemplary wall assembly 300 of combustor 16. In some embodiments, wall assembly 300 may be devoid of retainers 32. Wall assembly 300 may include brackets 34 providing substantially rigid connections between insert 26 and respective inner panels 24A, 24B. In some embodiments, brackets 34 may be integrally formed with respective inner panels 24A, 24B in order to have a unitary construction therewith. Alternatively, brackets 34 may be formed separately from inner panels 24A, 24B and subsequently assembled with inner panels 24A, 24B. In various embodiments, brackets 34 may be made of a metallic material or may be made from a composite (e.g., CMC) material.

Brackets 34 may be engaged with respective upper flanges 26C of insert 26. Brackets 34 and upper flanges 26C may provide a sliding engagement between inner panels 24A, 24B and insert 26. For example, brackets 34 and upper flanges 26C may accommodate some lateral movement between inner panels 24A, 24B and insert 26. In some embodiments, brackets 34 and upper flanges 26C may limit relative inward/outward movement between insert 26 and inner panels 24A, 24B. Accordingly, the connection provided by brackets 34 and upper flanges 26C may limit the movement of insert 26 relative to inner panels 24A, 24B along at least one degree of freedom. A suitable seal 35 may be provided to seal upper flanges 26C with respective brackets 34. Such seal 35 may be a suitable mechanical seal made of a high-temperature alloy. Damper 28 may be disposed between insert 26 and outer shell 22 and may provide a resilient connection therebetween.

Figure 4:
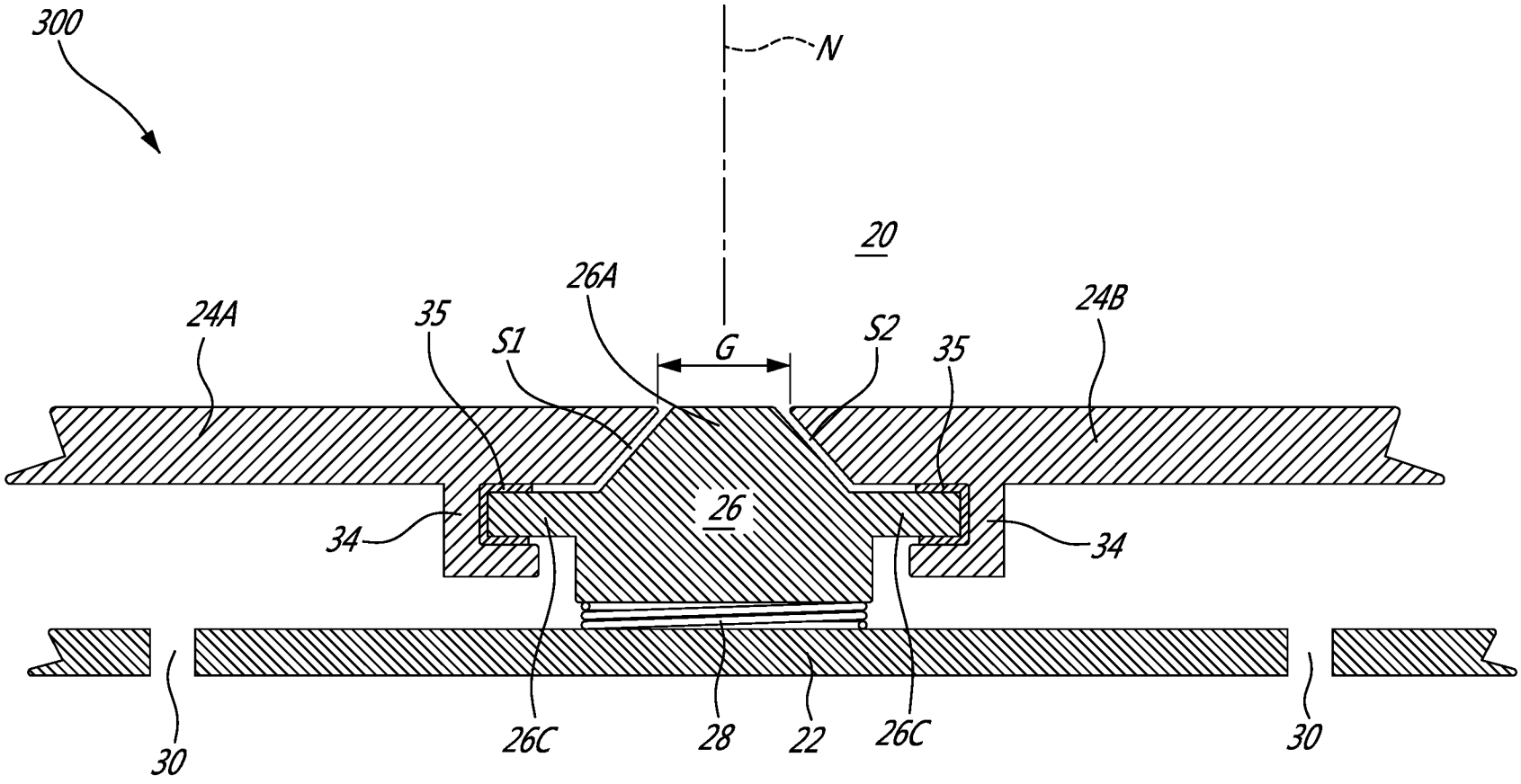
FIG. 4 is a schematic cross-sectional view of another exemplary wall assembly of the combustor of the engine of FIG. 1.
Figure 4:
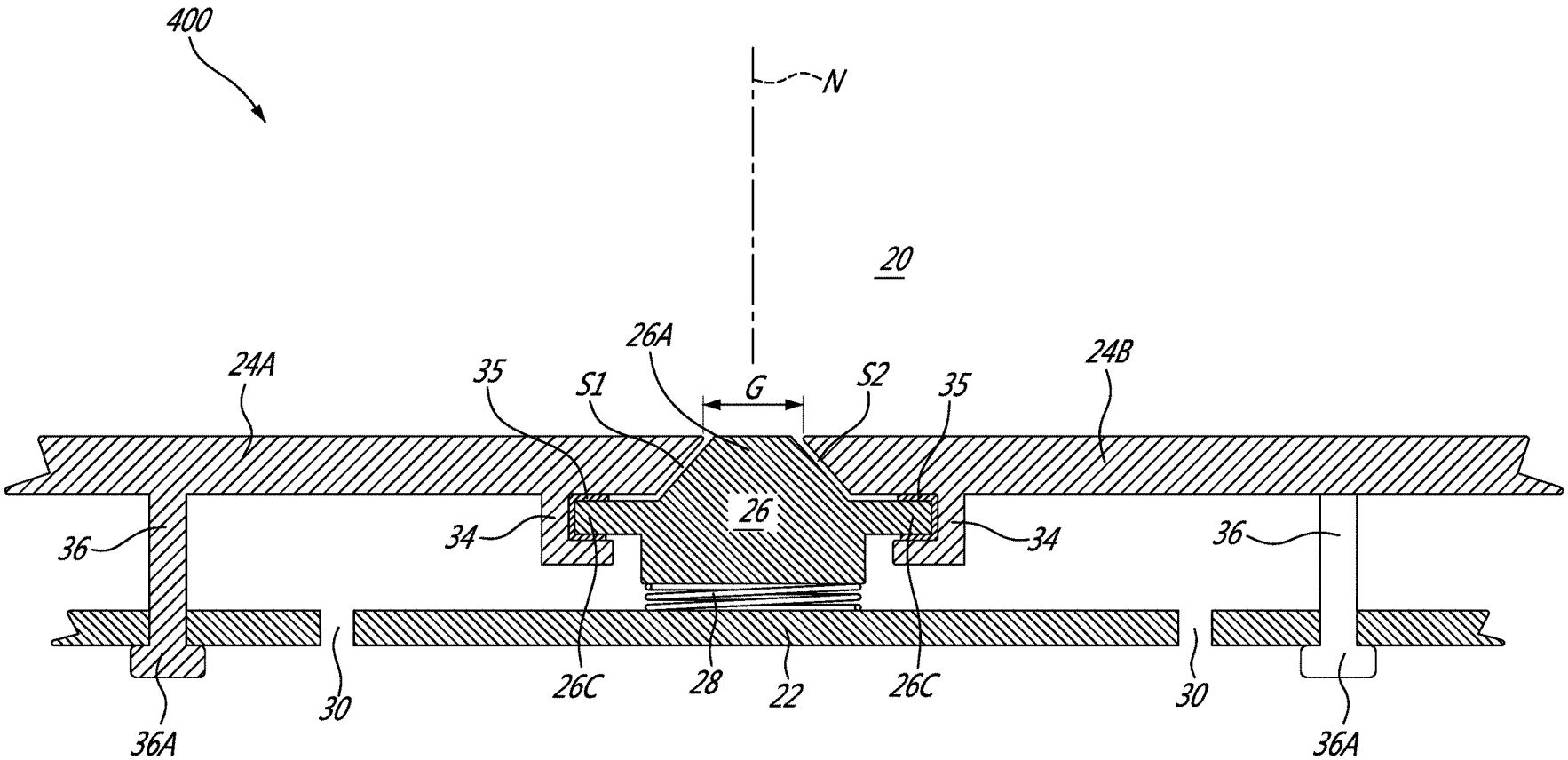

FIG. 4 is a schematic cross-sectional view of another exemplary wall assembly 400 of combustor 16. Wall assembly 400 may be generally similar to wall assembly 300 except for the addition of one or more pins 36 that may serve to guide relative inward/outward movement between inner panels 24A, 24B and outer shell 22. For example, pins 36 may be secured (e.g., threaded or otherwise anchored) to respective inner panels 24A, 24B and be in sliding engagement with outer shell 22 via respective holes formed in outer shell 22. Heads 36A of pins 36 may prevent excessive spacing between inner panels 24A, 24B and outer shell 22. In some embodiments, pins 36 may be integrally formed with respective inner panels 24A, 24B in order to have a unitary construction therewith. Alternatively, pins 36 may be formed separately from inner panels 24A, 24B and subsequently assembled with inner panels 24A, 24B. Pins 36 may be included in any one of wall assemblies 200, 300, 500 and 600 in some embodiments. In various embodiments, pins 36 may be made of a metallic material or may be made from a composite (e.g., CMC) material.

Figure 5:
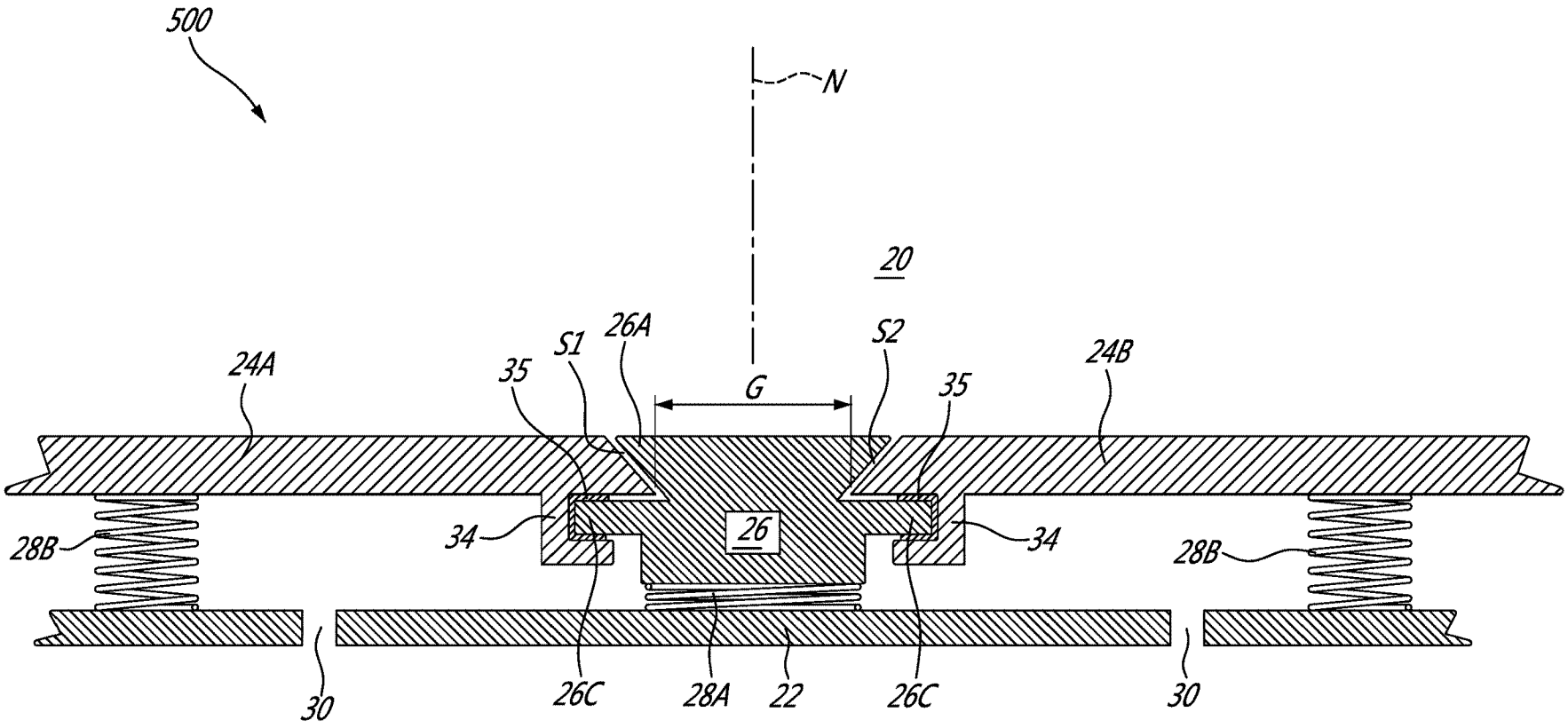
FIG. 5 is a schematic cross-sectional view of another exemplary wall assembly of the combustor of the engine of FIG. 1.

FIG. 5 is a schematic cross-sectional view of another exemplary wall assembly 500 of combustor 16. Wall assembly 500 includes an alternate configuration of insert 26 where part 26A of insert 26 disposed in gap G between inner panels 24A, 24B tapers toward outer shell 22 instead of away from outer shell 22 as in wall assemblies 200, 300 and 400. Wall assembly 500 may include one or more dampers 28A disposed between insert 26 and outer shell 22. Instead or in addition, wall assembly 500 may include one or more dampers 28B disposed between inner panels 24A, 24B and outer shell 22 without intermediate insert 26. For example, dampers 28B may be in direct engagement with outer shell 22 and respective inner panels 24A, 24B. Dampers 28B may be included in any one of wall assemblies 200, 300 and 400 in some embodiments.

Figure 6:
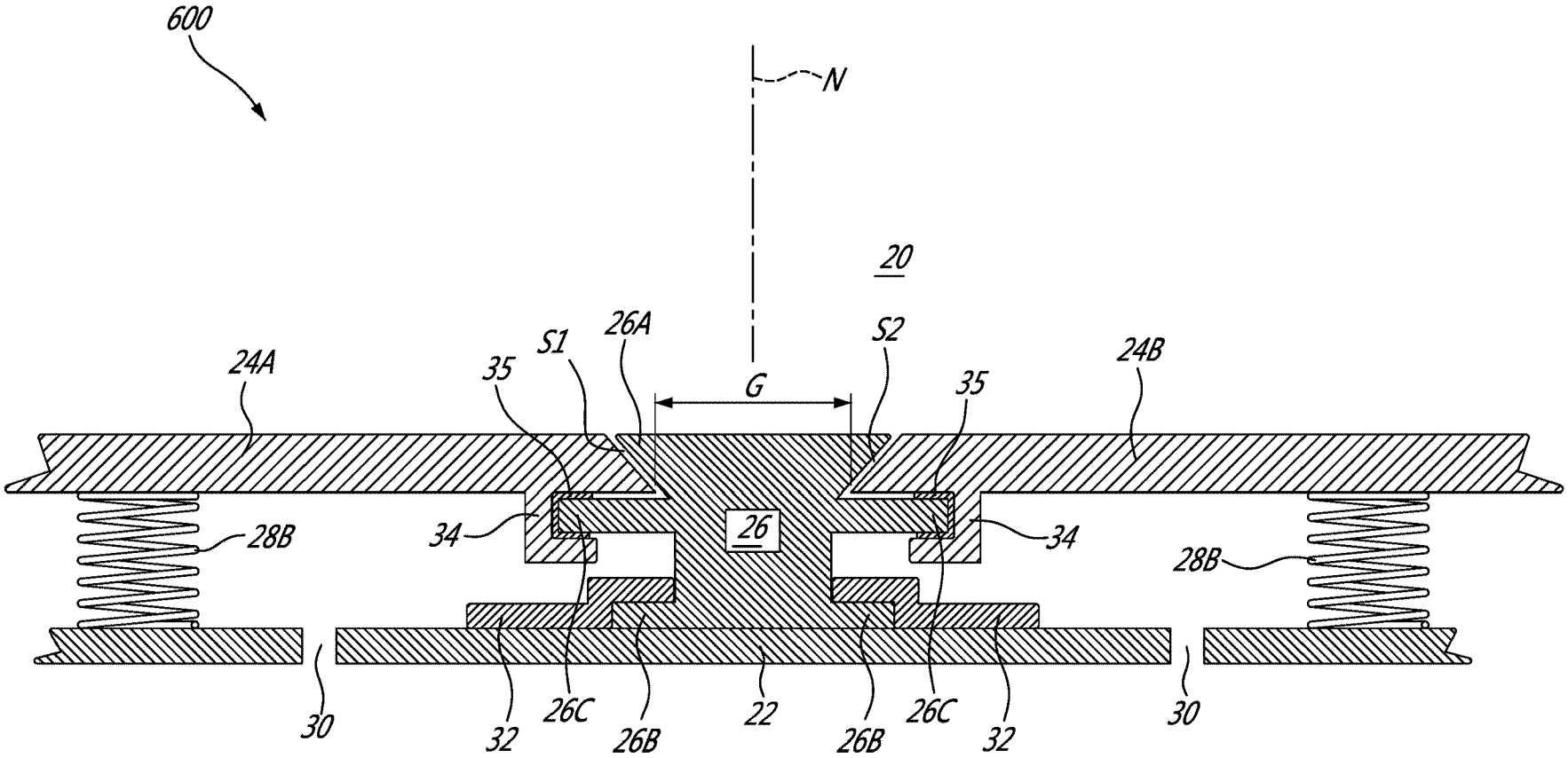
FIG. 6 is a schematic cross-sectional view of another exemplary wall assembly of the combustor of the engine of FIG. 1.

FIG. 6 is a schematic cross-sectional view of another exemplary wall assembly 600 of combustor 16. Wall assembly 600 may be generally similar to wall assembly 500 except for the removal of damper 28A and for the addition of Z-shaped retainers 32. Retainers 32 may be engaged with respective lower flanges 26B in order to provide a relatively rigid connection between insert 26 and outer wall 22. For example, the connection provided by retainers 32 and lower flanges 26B may limit relative movement between insert 26 and outer shell 22. In the embodiment shown, inward/outward and lateral relative movement between insert 26 and outer shell 22 may be limited or prevented by retainers 32. Wall assembly 600 may be devoid of a damper disposed between insert 26 and outer shell 22.

The above description is meant to be exemplary only, and one skilled in the relevant arts will recognize that changes may be made to the embodiments described without departing from the scope of the invention disclosed. The present disclosure may be embodied in other specific forms without departing from the subject matter of the claims. The present disclosure is intended to cover and embrace all suitable changes in technology. Modifications which fall within the scope of the present invention will be apparent to those skilled in the art, in light of a review of this disclosure, and such modifications are intended to fall within the appended claims. Also, the scope of the claims should not be limited by the preferred embodiments set forth in the examples, but should be given the broadest interpretation consistent with the description as a whole.

What is claimed is:

1. A combustor of a gas turbine engine, the combustor comprising:

an outer shell made of a metallic material;

a plurality of inner panels mounted to the outer shell, the plurality of inner panels spaced inwardly from the outer shell to define a double-wall configuration with the outer shell, the plurality of inner panels made of a ceramic material;

a damper disposed between the outer shell and a first inner panel of the plurality of inner panels; and an insert disposed between the first inner panel and the outer shell, wherein:

the first inner panel and a second inner panel of the plurality of inner panels are positioned to define a gap therebetween;

part of the insert is disposed in the gap between the first inner panel and the second inner panel;

the part of the insert disposed in the gap includes first sealing faces oriented obliquely to a normal of an inner surface of the outer shell;

the first inner panel and the second inner panel each include a second sealing face oriented obliquely to the normal of the inner surface of the outer shell;

the first sealing faces of the insert are in respective sliding engagement with the second sealing faces of the first inner panel and of the second inner panel; and the insert includes:

a first flange engaged with a first bracket rigidly attached to the first inner panel, the first flange being spaced apart from the outer shell; and a second flange engaged with a second bracket rigidly attached to the second inner panel, the second flange being spaced apart from the outer shell;

wherein:

the first bracket defines a first channel separate from the outer shell, the first flange of the insert being received in the first channel; and the second bracket defines a second channel separate from the outer shell, the second flange of the insert being received in the second channel.

2. The combustor as defined in claim 1, wherein the damper is resilient.

3. The combustor as defined in claim 1, wherein the damper is a spring.

4. The combustor as defined in claim 1, wherein the damper is disposed between the outer shell and the insert.

5. The combustor as defined in claim 1, wherein the damper is in direct engagement with the outer shell and the first inner panel.

6. The combustor as defined in claim 1, wherein:

the damper is a first damper disposed between the insert and the outer shell; and the combustor includes a second damper in direct engagement with the outer shell and the first inner panel.

7. The combustor as defined in claim 1, wherein:

the damper is a first damper disposed between the insert and the outer shell; and the combustor includes:

a second damper disposed between the outer shell and the first inner panel; and a third damper disposed between the outer shell and the second inner panel.

8. The combustor as defined in claim 1, wherein the part of the insert disposed in the gap between the first inner panel and the second inner panel tapers away from the outer shell.

9. The combustor as defined in claim 1, wherein the part of the insert disposed in the gap between the first inner panel and the second inner panel tapers toward the outer shell.

10. The combustor as defined in claim 1, wherein:

the insert is secured to the outer shell to limit movement of the insert relative to the outer shell; and the damper is in direct engagement with the outer shell and the first inner panel.

11. The combustor as defined in claim 10, wherein the insert is secured to the first inner panel and to the second inner panel via rigid connections.

12. The combustor as defined in claim 11, wherein the insert includes a third flange for securing the insert to the outer shell.

13. The combustor as defined in claim 12, wherein the first flange is sealingly engaged with the first inner panel.

14. The combustor as defined in claim 1, comprising a retainer secured to the outer shell for retaining the insert, wherein the damper is disposed between the insert and the outer shell.

15. The combustor as defined in claim 1, wherein the plurality of inner panels and the insert are made from substantially a same type of material.

16. The combustor as defined in claim 1, comprising a pin secured to the first inner panel and in sliding engagement with the outer shell.

17. A combustor of a gas turbine engine, the combustor comprising:

an outer shell;

a plurality of inner panels mounted to the outer shell, the plurality of inner panels spaced inwardly from the outer shell to define a double-wall configuration with the outer shell, the plurality of inner panels having a higher heat resistance than the outer shell;

a damper disposed between the outer shell and a first inner panel of the plurality of inner panels; and an insert disposed between the first inner panel and the outer shell, wherein:

the first inner panel and a second inner panel of the plurality of inner panels are positioned to define a gap therebetween;

part of the insert is disposed in the gap between the first inner panel and the second inner panel;

the part of the insert disposed in the gap includes first sealing faces oriented obliquely to a normal of an inner surface of the outer shell;

the first inner panel and the second inner panel each include a second sealing face oriented obliquely to the normal of the inner surface of the outer shell; and the first sealing faces of the insert are in respective sliding engagement with the second sealing faces of the first inner panel and of the second inner panel;

the insert includes:

a first flange engaged with a first bracket of the first inner panel, the first flange being spaced apart from the outer shell; and a second flange engaged with a second bracket of the second inner panel, the second flange being spaced apart from the outer shell;

wherein:

the first bracket of the first inner panel defines a first channel separate from the outer shell, the first flange of the insert being received in the first channel; and the second bracket of the second inner panel defines a second channel separate from the outer shell, the second flange of the insert being received in the second channel.

18. The combustor as defined in claim 17, wherein the first sealing faces of the insert are oriented at an angle of between 30° and 60° from the normal of the inner surface of the outer shell.

19. The combustor as defined in claim 1, comprising:

a first seal disposed between the first flange and the first bracket; and a second seal disposed between the second flange and the second bracket.

* * * * *